US011647792B2

(12) United States Patent
Liu

(10) Patent No.: US 11,647,792 B2
(45) Date of Patent: May 16, 2023

(54) ELECTRONIC CIGARETTE

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 300 days.

(21) Appl. No.: 17/013,641

(22) Filed: Sep. 6, 2020

(65) Prior Publication Data

US 2021/0153559 A1 May 27, 2021

(30) Foreign Application Priority Data

Nov. 26, 2019 (CN) ..... 201911170164.8
Nov. 26, 2019 (CN) ..... 201922058524.7

(51) Int. Cl.
*A24F 40/485* (2020.01)
*A24F 40/42* (2020.01)
*A24F 40/10* (2020.01)

(52) U.S. Cl.
CPC ..... *A24F 40/485* (2020.01); *A24F 40/10* (2020.01); *A24F 40/42* (2020.01)

(58) Field of Classification Search
CPC ..... A24F 40/10; A24F 40/485; A24F 40/42
See application file for complete search history.

(56) References Cited

U.S. PATENT DOCUMENTS

2019/0216135 A1* 7/2019 Guo ..... A24F 40/44

FOREIGN PATENT DOCUMENTS

CA 3086421 * 6/2019
WO 2015043126 * 4/2015

* cited by examiner

*Primary Examiner* — Jean F Duverne
(74) *Attorney, Agent, or Firm* — Matthias Scholl P.C.; Matthias Scholl

(57) ABSTRACT

An electronic cigarette including an atomization assembly and a battery assembly. The atomization assembly is disposed on the battery assembly. The atomization assembly is disposed on the battery assembly. The atomization assembly includes a rotatable ring disposed on one end of the atomization assembly; the rotatable ring is configured to adjust a volume of air and vapor of the electronic cigarette; the atomization assembly further includes a refillable cartomizer, an atomizer, and a silicone base disposed on one end of the refillable cartomizer; and the atomizer is in pluggable connection to the silicone base.

2 Claims, 5 Drawing Sheets

ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 201911170164.8 filed Nov. 26, 2019 and to Chinese Patent Application No. 201922058524.7 filed Nov. 26, 2019. The contents of all of the aforementioned applications, including any intervening amendments thereto, are incorporated herein by reference. Inquiries from the public to applicants or assignees concerning this document or the related applications should be directed to: Matthias Scholl P C., Attn.: Dr. Matthias Scholl Esq., 245 First Street, 18th Floor, Cambridge, Mass. 02142.

BACKGROUND

The disclosure relates to an electronic cigarette.

Electronic cigarettes atomize nicotine-containing e-liquid. A conventional cartomizer of the electronic cigarettes cannot be refilled with e-liquid. The atomizer is integrated with the cartomizer and cannot be replaced with a new one.

SUMMARY

The disclosure provides an electronic cigarette comprising an atomization assembly and a battery assembly. The atomization assembly is disposed on the battery assembly. The atomization assembly comprises a rotatable ring disposed on one end of the atomization assembly; the rotatable ring is configured to adjust a volume of air and vapor of the electronic cigarette; the atomization assembly further comprises a refillable cartomizer, an atomizer, and a silicone base disposed on one end of the refillable cartomizer; and the atomizer is in pluggable connection to the silicone base.

The atomization assembly further comprises a second silicone seal, a second support base, a third seal ring, and a base; the second silicone seal is disposed on the second support base; the third seal ring is disposed on the second support base to seal the rotatable ring; the rotatable ring is disposed on the second support base; the base is fixed on the second support base to fix the rotatable ring; the rotatable ring comprises a side wall provided with an air hole corresponding to an air vent of the second support base; when in use, the volume of air and vapor of the electronic cigarette is adjustable upon the rotation of the rotatable ring.

The refillable cartomizer comprises a seal plug, an e-liquid storage tank, a silicone base, a first silicone seal, and a steel casing; the seal plug is disposed on a top end of the e-liquid storage tank; the silicone base is disposed on a bottom end of the e-liquid storage tank; the first silicone seal is disposed on a top end of the atomizer; the silicone base is disposed around the atomizer; the atomizer is disposed in the e-liquid storage tank; and the steel casing is disposed on the bottom end of the e-liquid storage tank.

The rotatable ring is disposed on one end of the atomization assembly to adjust the volume of air and vapor of the electronic cigarette. The cartomizer of the atomization assembly can be refilled with e-liquid and thus can be used repeatedly. The atomizer can be directly pulled out from the silicone base at the bottom of the cartomizer, so that the atomizer is easily replaced when the atomizer breaks down.

DETAILED DESCRIPTION

To further illustrate, embodiments detailing an electronic cigarette are described below. It should be noted that the following embodiments are intended to describe and not to limit the disclosure.

Figure 1:
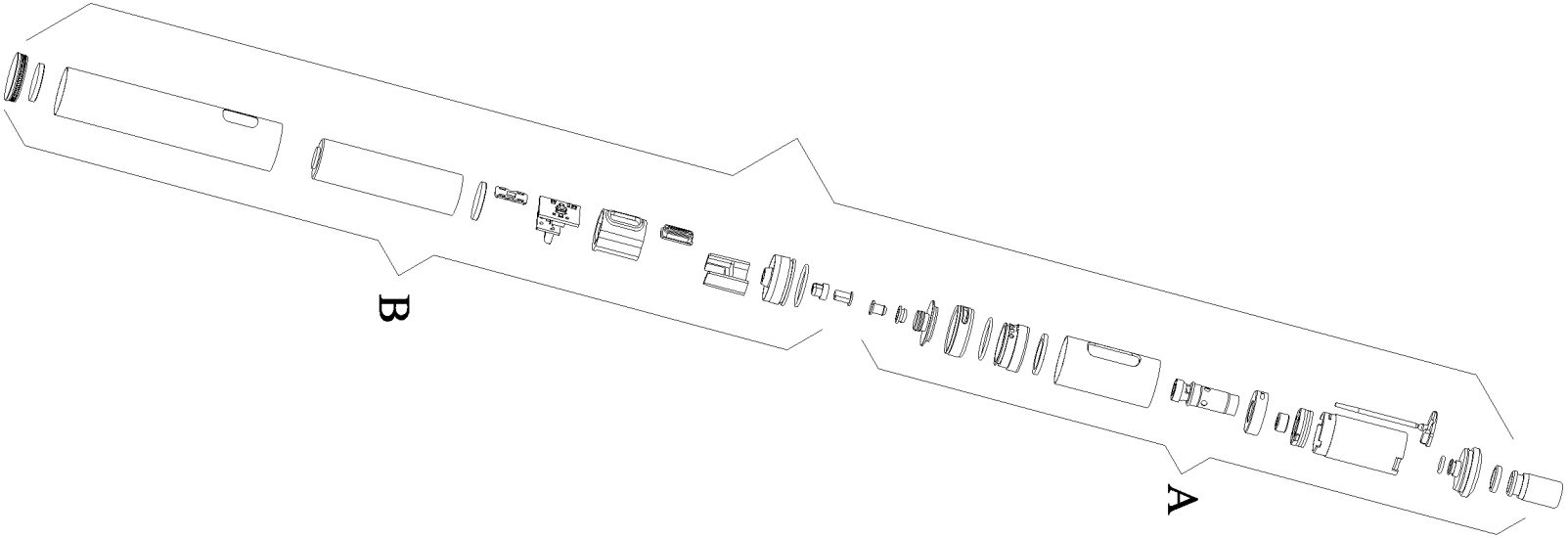
FIG. 1 is an exploded view of an electronic cigarette according to one embodiment of the disclosure.
Figure 2:
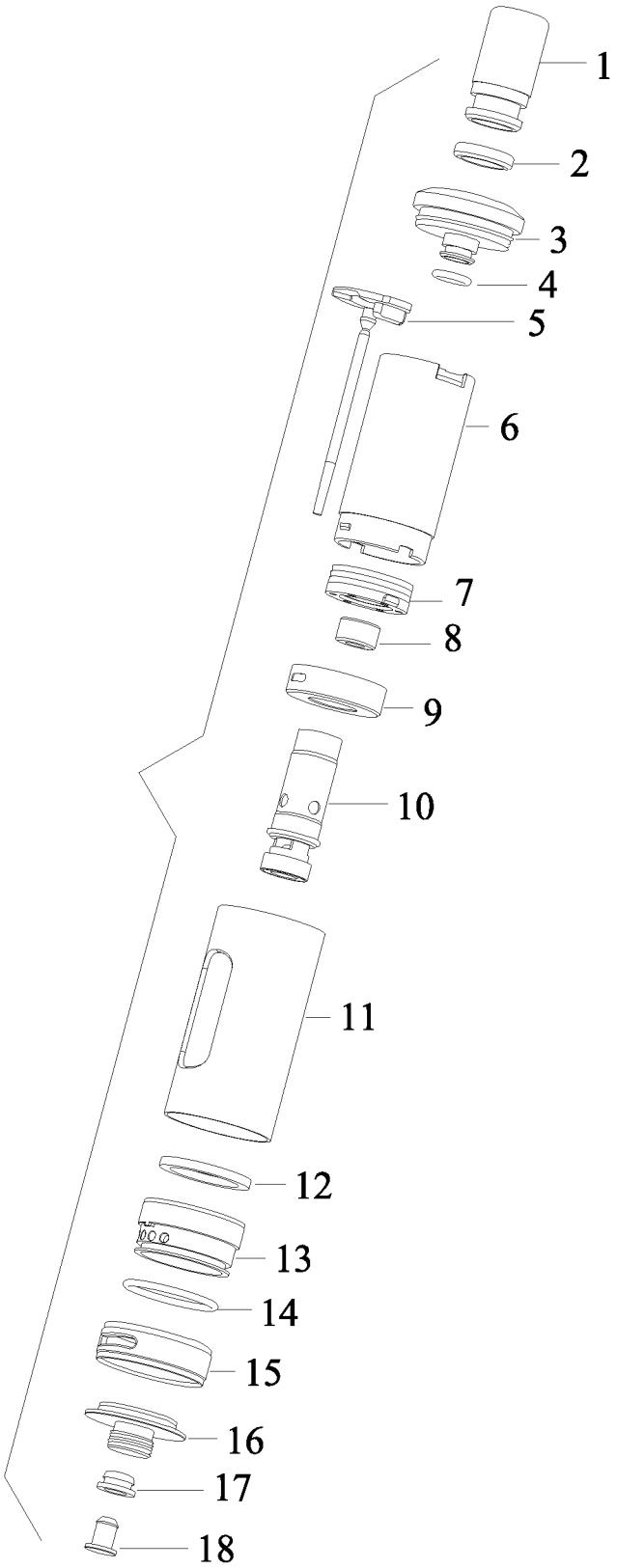
FIG. 2 is an exploded view of an atomization assembly in FIG. 1.
Figure 3:
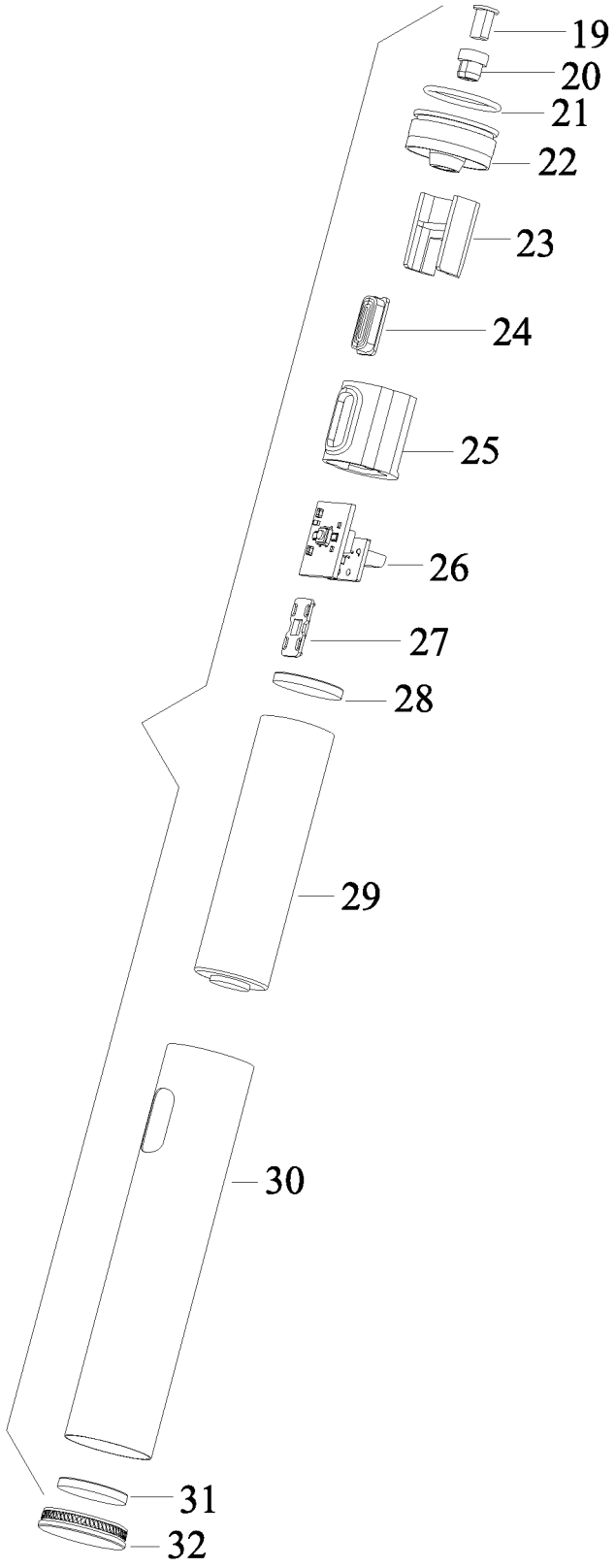
FIG. 3 is an exploded view of a battery assembly in FIG. 1.
Figure 4:
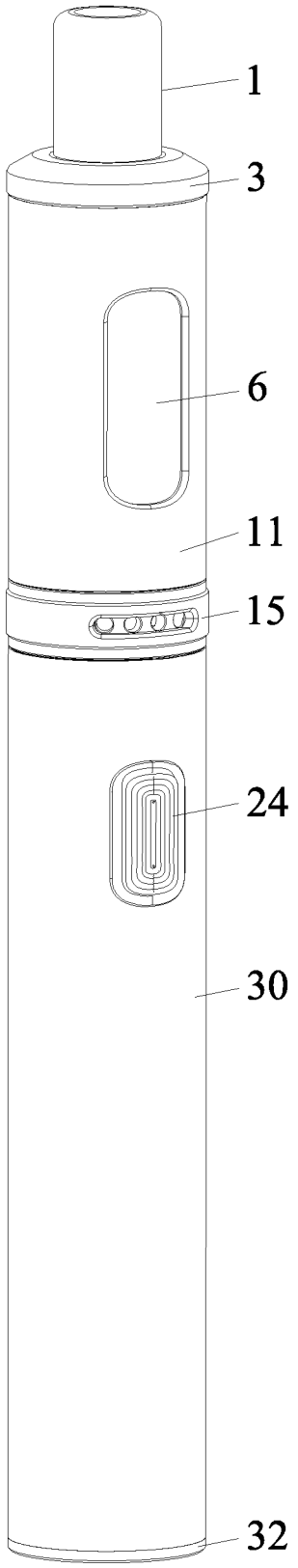
FIG. 4 is a schematic diagram of an electronic cigarette according to one embodiment of the disclosure.
Figure 5:
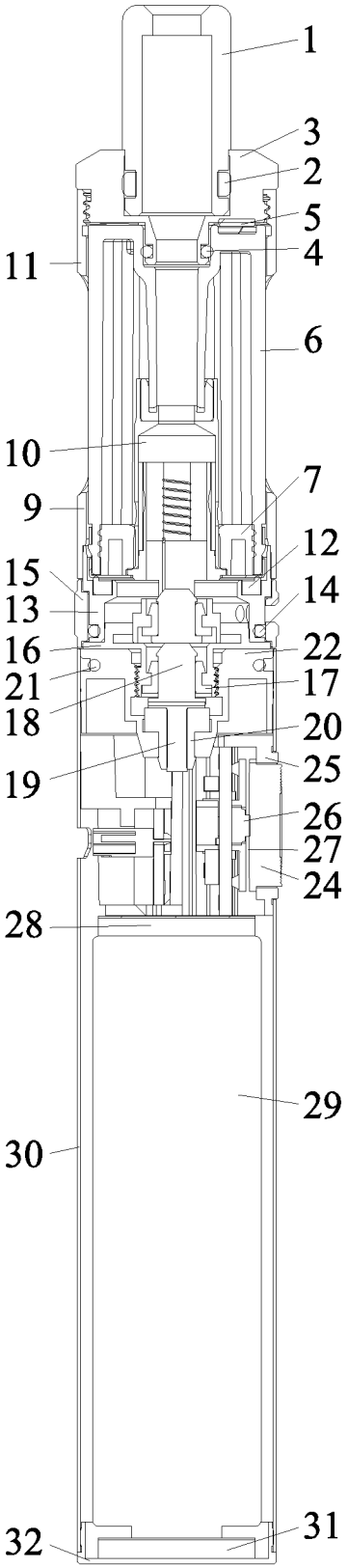
FIG. 5 is a sectional view of an electronic cigarette according to one embodiment of the disclosure.

As shown in FIGS. 1-5, an electronic cigarette comprises an atomization assembly A and a battery assembly B. The atomization assembly comprises a mouthpiece 1, a first seal ring 2, a first support base 3, a second seal ring 4, a seal plug 5, an e-liquid storage tank 6, a silicone base 7, a first silicone seal 8, a steel casing 9, an atomizer 10, an observation tube 11, a second silicone seal 12, a second support base 13, a third seal ring 14, a rotatable ring 15, a base 16, an insulation ring 17, and a joint 18. The first seal ring 2 is disposed on the mouthpiece 1, and the mouthpiece 1 is disposed on the first support base 3. The second seal ring 4 is wrapped around the first support base 3. The first support base 3 is disposed on the top of the observation tube 11. The seal plug 5 is disposed on the e-liquid storage tank 6. The silicone base 7 and the steel casing 9 are disposed on the bottom part of the e-liquid storage tank 6. The first silicone seal 8 is disposed in the atomizer 10, and the atomizer 10 is disposed on the silicone base 7. The e-liquid storage tank 6 is disposed in the observation tube 11. The insulation ring 17 and the joint 18 are consecutively disposed on the base 16. The base 16 is connected to the second support base 13. The second silicone seal 12 and the third seal ring 14 are disposed on the top and the side of the second support base 13, respectively. The rotatable ring 15 is wrapped around the second support base 13 and disposed on the bottom part of the observation tube 11. Specifically, the seal plug 5 is disposed on the e-liquid storage tank 6; the silicone base 7 and the steel casing 9 are disposed on the bottom part of the e-liquid storage tank 6; the first silicone seal 8 is disposed in the atomizer 10, and the atomizer 10 is disposed on the silicone base 7, whereby a cartomizer is formed. The rotatable ring 15 is disposed on one end of the atomization assembly to adjust the volume of air and vapor of the electronic cigarette. The cartomizer of the atomization assembly can be refilled with e-liquid and thus can be used repeatedly. The seal plug 5 of the cartomizer is a long strip, and the neck of the seal plug is easy to be pulled off thus simplifying the installation thereof. Thus, the seal plug is easily installed on the cartomizer to block the e-liquid inlet. The atomizer 10 can be directly pulled out from the silicone base 7 at the bottom of the cartomizer, so that the atomizer is easily replaced when the atomizer breaks down.

The battery assembly B comprises an electrode 19, an electrode insulator 20, a fourth seal ring 21, a threaded ring 22, a fastener 23, a button 24, a support 25, a control panel 26, a silicone button 27, a first ethyl vinyl acetate (EVA) pad 28, a battery cell 29, a cartridge 30, a second EVA pad 31, and a bottom cover 32. The control panel 26 is disposed on the fastener 23, and the fastener 23 is disposed on the support 25. The silicone button 27 is disposed on the button 24 and the button 24 is disposed on the support 25. The battery cell 29 is disposed on the control panel 26. The first ethyl vinyl acetate (EVA) pad 28 and the second EVA pad 31 are disposed on two ends of the electrodes of the battery cell 29. The battery cell 29 is disposed on the cartridge 30. The bottom cover 32 is disposed on one end of the cartridge 30. The electrode insulator 20 and the electrode 19 are consecutively disposed in the threaded ring 22. The fourth seal ring 21 is disposed around the threaded ring 22. The threaded ring 22 is disposed on the top of the cartridge 30. The atomization assembly A is disposed on the battery assembly B. The base 16 of the atomization assembly A is in threaded connection to the threaded ring 22 of the battery assembly B.

The following advantages are associated with the electronic cigarette of the disclosure. The rotatable ring is disposed on one end of the atomization assembly to adjust the volume of air and vapor of the electronic cigarette. The cartomizer of the atomization assembly can be refilled with e-liquid and thus can be used repeatedly. The seal plug of the cartomizer is a long strip, and the neck of the seal plug is easy to be pulled off thus simplifying the installation thereof. Thus, the seal plug is easily installed on the cartomizer to block the e-liquid inlet. The atomizer can be directly pulled out from the silicone base at the bottom of the cartomizer, so that the atomizer is easily replaced when the atomizer breaks down.

It will be obvious to those skilled in the art that changes and modifications may be made, and therefore, the aim in the appended claims is to cover all such changes and modifications.

What is claimed is:

1. An electronic cigarette, comprising: an atomization assembly and a battery assembly; the atomization assembly being disposed on the battery assembly; wherein:

the atomization assembly comprises a rotatable ring disposed on one end of the atomization assembly; the rotatable ring is configured to adjust a volume of air and vapor of the electronic cigarette; the atomization assembly further comprises a refillable cartomizer, an atomizer, and a silicone base disposed on one end of the refillable cartomizer; and the atomizer is in pluggable connection to the silicone base; and the atomization assembly further comprises a second silicone seal, a second support base, a third seal ring, and a base; the second silicone seal is disposed on the second support base; the third seal ring is disposed on the second support base to seal the rotatable ring; the rotatable ring is disposed on the second support base; the base is fixed on the second support base to fix the rotatable ring; the rotatable ring comprises a side wall provided with an air hole corresponding to an air vent of the second support base; when in use, the volume of air and vapor of the electronic cigarette is adjustable upon the rotation of the rotatable ring.

2. An electronic cigarette, comprising: an atomization assembly and a battery assembly; the atomization assembly being disposed on the battery assembly; wherein:

the atomization assembly comprises a rotatable ring disposed on one end of the atomization assembly; the rotatable ring is configured to adjust a volume of air and vapor of the electronic cigarette; the atomization assembly further comprises a refillable cartomizer, an atomizer, and a silicone base disposed on one end of the refillable cartomizer; and the atomizer is in pluggable connection to the silicone base; and the refillable cartomizer comprises a seal plug, an e-liquid storage tank, a silicone base, a first silicone seal, and a steel casing; the seal plug is disposed on a top end of the e-liquid storage tank; the silicone base is disposed on a bottom end of the e-liquid storage tank; the first silicone seal is disposed on a top end of the atomizer; the silicone base is disposed around the atomizer; the atomizer is disposed in the e-liquid storage tank; and the steel casing is disposed on the bottom end of the e-liquid storage tank.

* * * * *